United States Patent [19]

Hauberg

[11] 3,954,035

[45] May 4, 1976

[54] SLICING MACHINE HAVING FEED MEANS SYNCHRONIZED WITH KNIFE ROTATION

[75] Inventor: Bent Hauberg, Birkerod, Denmark

[73] Assignee: Lynggaard Skandinavia, Copenhagen, Denmark

[22] Filed: Apr. 16, 1975

[21] Appl. No.: 568,472

[30] Foreign Application Priority Data

Apr. 18, 1974 Germany ..... 2418640

[52] U.S. Cl. ..... 83/207; 83/244; 83/278

[51] Int. Cl.[2] ..... B26D 5/20

[58] Field of Search ..... 83/278, 207, 209, 241, 83/244, 713, 719, 726, 431

[56] References Cited

UNITED STATES PATENTS 3,131,739 5/1964 Harrington ..... 83/209

*Primary Examiner*—Willie G. Abercrombie

[57] ABSTRACT

The invention relates to a slicing machine having a hydraulic feed means, a piston pump synchronized with the rotation of the knife so that for each revolution of the knife a measured amount of fluid is supplied by the pump to the feed means thereby determining the increment of movement and thus, the slice thickness. The stroke length of the piston pump may be varied to change the slice thickness.

5 Claims, 1 Drawing Figure

SLICING MACHINE HAVING FEED MEANS SYNCHRONIZED WITH KNIFE ROTATION

Figure 1:
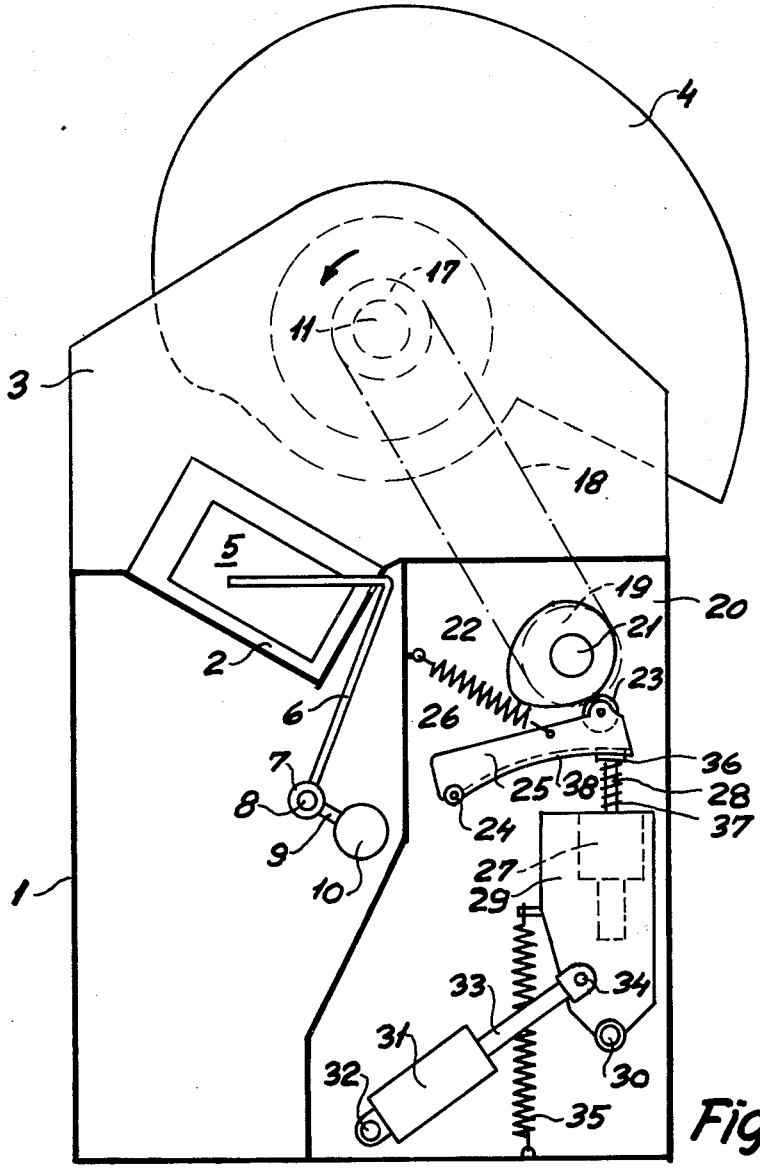

This invention relates to a slicing machine comprising a rotating knife and a means for advancing the object to be sliced, such advancing means being movable substantially perpendicular to the plane of rotation of the knife by means of a hydrualic cylinder. Such machines are used for instance for cutting sausages into sandwich slices and lumps of meat into cutlets and the like. In the known machines of this type the advancing means is moved continuously forward towards the knife at a suitably low speed so that the elasticity of the knife permits a deflection of the knife corresponding to the length which the object is passed forward during the passage of the knife through the object. The known art comprises other slicing machines which have an automatically controlled pawl mechanism that in effect chops up the advancing movement and divides it into small steps so that the object is not moved in the advancing direction during the cutting operation itself. This advantage has been achieved at the expense of the operational reliability and working life of the machine, because the many impacts caused by the pawl mechanism cause vibrations and highly increased wear.

It is the object of the present invention to provide a slicing machine of the aforesaid type which is capable of advancing the object stepwise without impacts and vibrations.

This object has been accomplished by a slicing machine provided with a piston pump driven in synchronization with the relative movement of the knife and the object in the plane of rotation of the knife by which the object is cut up, said piston pump feeding hydraulic fluid to the cylinder during the advance of the object for stepwise advance of the cylinder plunger connected to the advancing means. For each cutting movement the piston pump supplies a measured amount of hydraulic fluid to the hydraulic cylinder, the plunger of which is thus carried forward one step corresponding to the amount of fluid supplied. This motion of piston and advancing means can readily be performed softly and smoothly by a suitable construction of the pump activating means.

The machine is preferably of the type that has an eccentrically mounted knife, which may for instance be shaped as a sickle, so that the object shall only be moved axially in relation to the knife, but the machine may also be of the type having a disc-shaped circular knife and where the object is advanced on a slice which is moved parallel to the knife plane during the cutting operation. In that case it is to this movement the operation of the piston pump shall be synchronized.

Where the machine has an eccentrically mounted knife while the pump piston is spring loaded and activated by a curved disc rotating in synchronization with the knife, the pump is mounted in a housing which is pivotable about an axis parallel to the axis of the curved disc and the free end of the piston rod of the pump abuts on and is slidable along an arm, one end of which is mounted rotatably about a third axis parallel to the two first axes and the other end of which abuts on the curved disc. Thus the stroke length of the pump piston can be varied continuously by oscillation of the pump housing, so that also the amount of fluid supplied in each stroke and thus the length of each step of the advancing means and consequently the slice thichness can be varied continuously.

A machine of this type and comprising a hydraulic system for controlling the movements of the advancing means and an accumulator may be provided with hydraulic coupling means which during the reverse movement of the advancing means connect the pump with the accumulator and with a hydraulic pump adjustment cylinder connected to the pump housing so as to swing the pump housing into the position in which the piston rod engages the outer end of the arm. The accumulator will then be charged automatically by the pump during the reverse movement of the advancing means, and at the beginning of this reverse movement the pump will be adjusted automatically to the maximum stroke length so that the accumulator is charged as fast as possible.

By providing communication from the space behind the plunger of the hydraulic cylinder to a second accumulator and through a relief valve to a reservoir for hydraulic fluid it has been ensured that the plunger of the hydraulic cylinder operates against a suitable counter-pressure determined by the relief valve during the advancing steps, which results in a smooth braking of the movable members.

By providing a valve which on being activated establishes communication between the two ends of the hydraulic cylinder it becomes possible to use the second accumulator to reverse the advancing means by opening the valve, for instance by means of an end stop. Thus the fluid pressure will be the same on both sides of the plunger of the hydraulic cylinder, and the plunger area being greater at the front than at the rear, where it is reduced by the sectional area of the rod, the pressure of the fluid against the plunger will be greater at the front and the plunger will be carried back to its starting position, which may also be defined by means of an end stop which causes the valve to close and which may be adjustable.

Figure 2:
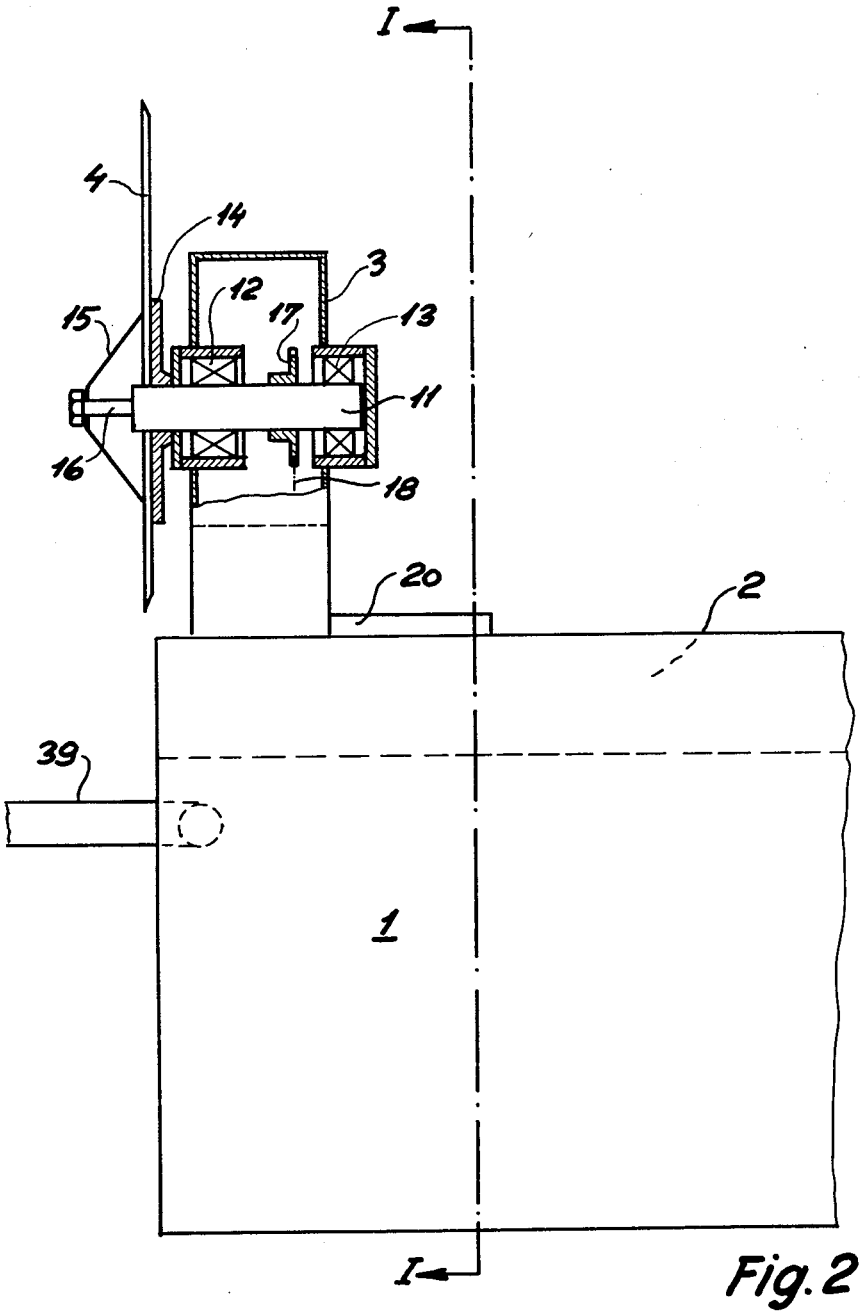
Figure 3:
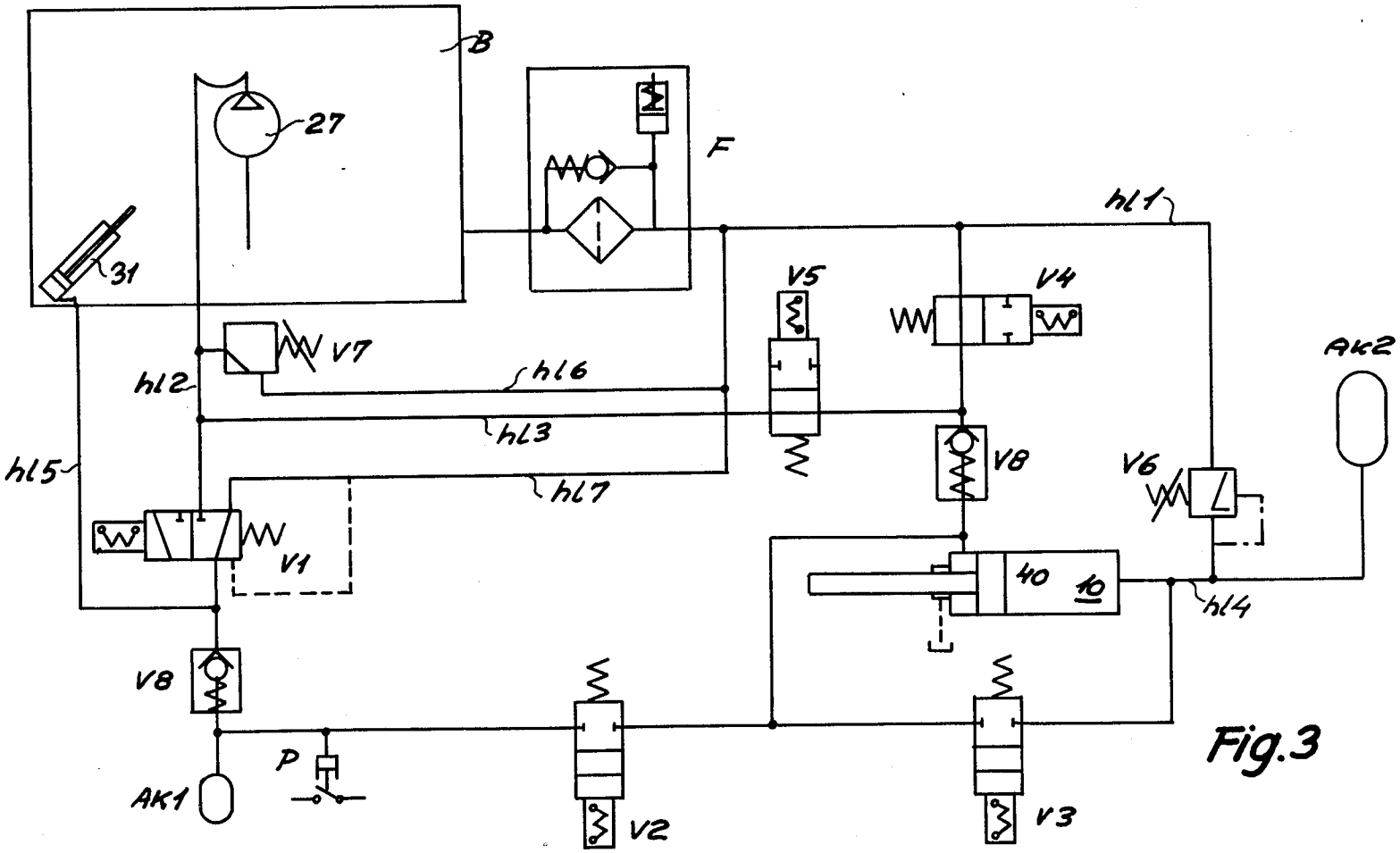
Figure 4:
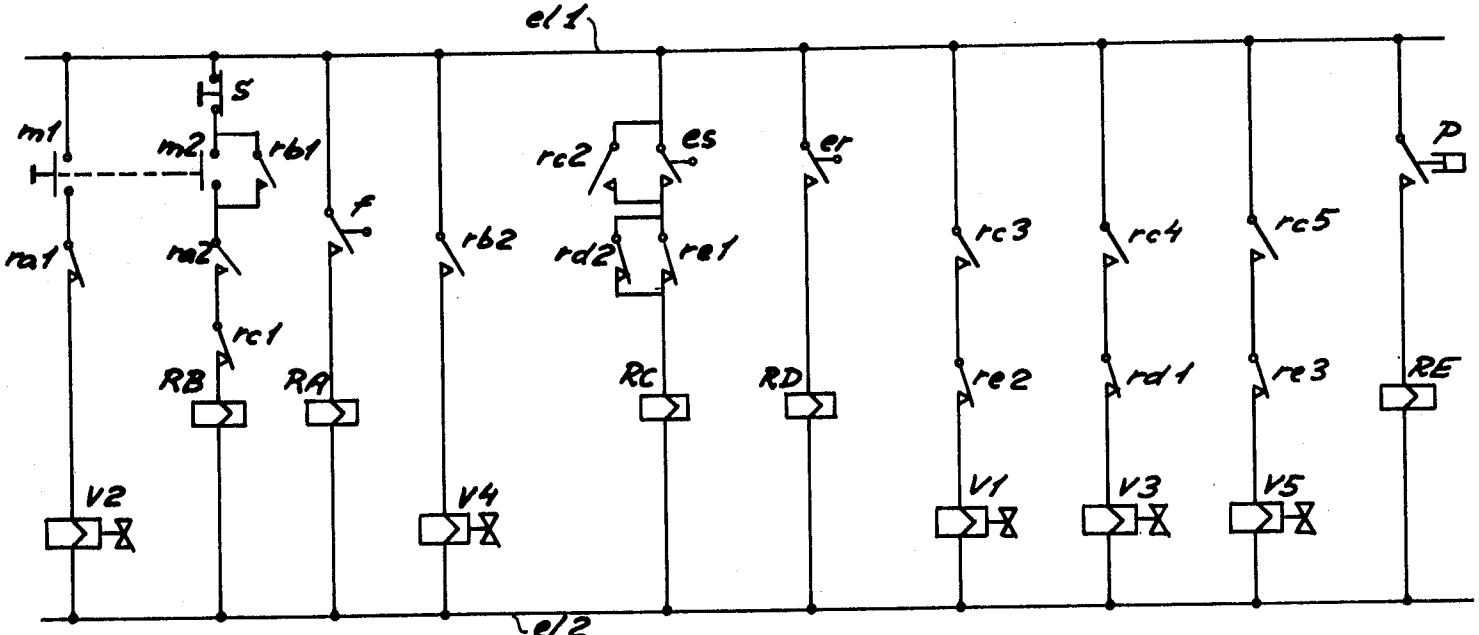

The invention will be explained in greater detail below with reference to the drawing, in which FIG. 1 presents a schematic vertical section through an embodiment of the machine according to the invention, FIG. 2 shows the front part of the machine viewed from one side and partially in section, FIG. 3 is a diagram of the hydraulic system in the machine, and FIG. 4 is a diagram of an electric circuit for controlling the valves of the hydraulic system.

In the upper surface of the machine housing 1, FIGS. 1 and 2, is provided a longitudinally extending slideway 2 defined by two inclined walls disposed at right angles to each other, wherein the meat to be sliced may be advanced towards a knife 4 by means of a push plate 5 which is secured by means of an angular arm 6 to a sleeve 7. The sleeve 7 is slidable on a guide rod 8 extending lengthwise in the machine and is connected by means of an arm 9 to the plunger rod of a hydraulic cylinder 10 extending parallel to the guide rod 8.

The knife 4, which is shown most clearly in FIG. 2, is fastened on a shaft 11, which is mounted rotatably in bearings 12 and 13 in a bracket 3 at one end of the housing 1, by means of a disc 14 attached to the shaft, a conical dished tightening member 15 and a bolt 16 which is screwed into the end of the shaft 11. Opposite the meat slide 2 the bracket 3 is defined downwardly by two faces forming a right angle between them and defining together with the meat slide a support of rectangular cross-section for the meat.

A chain wheel 17 mounted on the shaft 11 is driven by a chain 18 from a second chain wheel 19 mounted on a shaft 21 which is mounted rotatably in a space 20 adjacent to the bracket 3. The two chain wheels 17 and 19 have the same number of teeth so that the shafts 11 and 21 will rotate at the same speed. On the shaft 21 is further mounted a curved disc 22, against which a roll 23, which is mounted rotatably on an arm 25 pivotable about a pivot 24, is held in engagement by a tension spring 26. A piston pump 27 with a piston rod 28 is mounted in a housing 29 which can be pivoted clockwise,, FIG. 1, about a pivot 30 by means of a hydraulic cylinder 31, which at 32 is rotatably connected to the housing 1 and whose plunger shaft 33 is rotatably connected at 34 to the pump housing 29. A tension spring 35 urges the housing 29 to rotation in the opposite direction, that is counterclockwise in FIG. 1. The end of the piston rod 28 of the pump 27 has a head 36 which by means of a pressure spring 37 is held in engagement with the under side of the arm 25, which is formed as an arc with its center in or adjacent to the pivot 30 of the pump housing 29 and provided with a track 38 in which the head 36 of the piston rod 28 can slide during the rotation of the pump housing.

The shaft 21 is driven by an electromotor (not shown in the drawing) and for each rotation of the shaft the cutting edge of the knife 4 is passed down in front of the slideway 2 supporting the meat, and the curved disc 22 urges through the arm 25 the piston of the pump 27 down to perform a working stroke against the action of the springs 26 and 37. The length of the working stroke and thereby the amount of oil supplied by the pump in each stroke can be adjusted by the oscillation of the pump housing 29 about the pivot 30 and the resultant displacement of the head 36 of the piston rod on the arm 25. The said rotation of the pump housing 29 may be effected partly by means of an external handle (not shown) on the housing 1, partly by means of the hydraulic cylinder 31.

The pump 27 is connected in a manner which will be described later in connection with the hydraulic diagram shown in FIG. 3 to the hydraulic cylinder 10, which by means of the push plate 5 causes the meat to be advanced in the slideway 2, and thus the said push plate will be advanced one step for each piston stroke and consequently for each rotation of the knife 4. By adjustment of the length of the piston stroke the length of the advancing step and consequently the thickness of the slice of meat will be adjusted. The cut slices of meat will subside on to and be carried away by a conveyor belt 39.

In FIG. 3, B is an oil container into which the suction line of the pump 27 extends. The hydraulic system comprises interalia a plurality of magent controlled valves V1–V5 which are controlled by the electric control circuit shown in FIG. 4, and both the hydraulic and the electric circuit will be described below by way of a typical working cycle. The electric control circuit receives current from two lines *el* 1 and *el* 2 connected to their respective poles of a suitable, not shown, power source. In FIG. 4 all relays are indicated by capitals and their contacts by the corresponding small letters followed by a number where the relay contains several contacts.

At the start of the working cycle the plunger 40 of the advancing cylinder 10 is in the retracted position shown in FIG. 3. A piece of meat is deposited in the slideway 2 forward of the push plate 5, and a manually operated springloaded push button switch *m*1, m2, FIG. 4, is activated. This closes, through a break contact ra 1, a magnetizing circuit for a magnet valve V2, which is activated to establish connection between an accumulator AK1 and the advancing cylinder 10. The discharge side of this cylinder is connected through a lead *hl* 4 to an accumulator AK2 and through a pressure reduction valve V6 to a return line *hl* 1 leading through a filter F back to the oil container B. The valve V6 is adapted to open at a much lower pressure than the pressure in the accumulator AK1, and the oil fed therefrom will therefore urge the plunger 40 forward. The oil pressed out from the discharge side of the cylinder 10 will charge the accumulator AK2 and when the pressure therein has reached the valve determined by the adjustment of the valve 6 this valve opens and passes excess oil to the return line *hl* 1. The forward movement of the push member 5 continues until the meat reaches the knife 4, which detected by the activation of a sensor f, FIG. 4, whereby the relay RA is energized to open the magnetizing circuit of the valve V2 at the break contact *ra* 1, whereupon the valve V2 returns to the rest position indicated in FIG. 3 and cuts off the oil supply to the cylinder 10 so as to arrest the movement of the plunger thereof. The relay RA further closes a contact *ra* 2, whereby a relay RB is energized through a stop contact *s*, the currently energized pressure switch m2, the contact ra 2 and a break contact *rc* 1. The relay RB closes its own maintenance circuit at *rb* 1 and at *rb* 2 a magnetizing circuit for a magnet valve V4, which is closed and thus cuts of the connection from the pressure line *hl* 2 of the pump 27 through a line *hl* 3, in which a magnet valve V5 is interposed, to the return line *hl* 1. This increases the pressure in the line *hl* 3 and opens at each pump stroke a non-return valve V8 through which the oil reaches the advancing cylinder 10, whose plunger is advanced one step for each pump stroke. The stepwise advance of the push plate 5 continues until the plate support arm 6 abuts on and closes an end stop contact *es*, whereby the relay RC is energized through two break contacts *rd* 2 and *re* 1 connected in parallel. The relay RC closes its own maintenance circuit at *rc* 2 and opens at *rc* 1 the magnetizing circuit of the relay RB, which falls out and opens at *rb* 2 the magnetizing circuit of the magnet valve V4, which again connect the line *hl* 3 and the return line *hl* 1, whereby the high pressure in the line *hl* 3 is relieved and the stepwise movement of the advancing plunger 40 is arrested.

The relay RC moreover closes a magnetizing circuit at *rc* 3 through a break contact *re* 2 for a magnet valve V!, which is activated and connects the pressure line *hl* 2 of the pump 27 to the accumulator AK1 through a non-return valve V8. Simultaneously the magnet valve V5 is closed by the contact *rc* 5 closing its magnetizing circuit through a break contact *re* 3 thus cutting off the connection between the pressure line *hl* 2 and the return line *hl* 1, and the accumulator AK1 will then be charged by the pump 27. Moreover, pressure oil will be fed to the hydraulic cylinder 31, which is connected through the line *hl* 5 to the connection line between the magnet valve V1 and the non-return valve V8 and which will then turn the pump housing 29 clockwise, FIG. 1, into the position indicated in the drawing, in which the head 36 of the piston rod 28 abuts on the outer end of the arm 25, if the pump housing is not already in that position. Thus it is ensured that the pump 27 will operate at maximum capacity during the charging of the accumulator.

A further contact *rc* 4 on the relay RC closes, through a break contact *rd* 1, the magnetizing circuit of a magnet valve V3, which is activated and connects the feed side of the advancing cylinder with its discharge side. Thus both sides of the piston 40 will be subjected to the pressure in the accumulator AK2, but the piston area on the feed side being reduced by the cross-section area of the piston rod, the piston will be subjected to a resultant rearward force and move in that direction. This movement continues until the support arm 6 of the push plate 5 strikes and activates an end stop contact er, whereby the relay RD is energized to open at *rd* 1 the magnetizing circuit of the magnet valve V3, which is closed and arrests the return movement of the plunger 40. Moreover, the relay RD opens its break contact *rd* 2, which is disposed in series with the relay RC parallel to the break contact re 1.

To the accumulator AK1 is connected a pressure switch P which closes its contact when the accumulator pressure during charging reaches a predetermined value and thus energizes a relay RE. This relay opens its break contact *re* 2 and *re* 3 in series with the magnet valves V1 and V5 respectively, so that the valve V1 is closed and the valve V5 opened so that the charging of the accumulator AK1 is terminated and the pressure line *hl* 2 again connected to the return line *hl* 1.

The relay RE, moreover, opens its break contact *re* 1, which is disposed in parallel with the break contact *rd* 2. When the latter of these two break contacts opens, it opens the magnetizing circuit of relay RC, which opens its make-contacts *rc* 2, *rc* 3, *rc* 4 and *rc* 5 and closes its break contacts rc 1 in the magnetizing circuit of relay RB. The machine has now been returned to its initial position and a new working cycle can start.

To the pressure line *hl* 2 of the pump is connected an overflow valve V7, which is adjusted to open at a predetermined pressure which is higher that the activating pressure of the pressure switch P, thus connecting the pressure line through a line *hl* 6 to the return line *hl* 1.

The magnet valve V1 is a three-way valve which in the shown rest position, in which it breaks connection between the pressure line *hl* 2 and the accumulator AK1, connects the line *hl* 5 from the hydraulic cylinder 31 to the return line *hl* 1 through a line *hl* 7. This enables the piston in the hydraulic cylinder 31 to move freely and thus permits manual adjustment of the pump housing 29 to variation of the pump stroke.

The stop contact s makes it possible to arrest the automatic stepwise advance of the piston 40 and the push plate 5 connected thereto whenever desired, in that this contact on being manually activated will open the magnetizing circuit of relay RB and thus also the magnetizing circuit of the magnet valve V4.

The machine according to the invention can be used for other purposes than the cutting of cutlets, for instance for slicing bread, cheese or other objects. Also the structural details of the machine may be modified in many ways within the scope of the invention.

What I claim is:

1. A slicing machine comprising a rotating knife and an advancing means for the object to be sliced, said advancing means being movable substantially perpendicular to the plane of rotation of the knife by means of a hydraulic cylinder, characterized by a piston pump, means for driving said piston pump in synchronization with the relative movement of the knife and the object in the plane of rotation of the knife by which the object is cut up in such a manner that the piston pump performs a stroke for each cutting operaton, said piston pump feeding hydraulic fluid to the cylinder during the advance of the object for stepwise advancing the cylinder plunger connected to the advancing means.

2. A machine according to claim 1 and in which the pump piston is spring loaded and activated by a curved disc rotating in synchronization with the knife, characterized in that the pump is mounted in a housing which is pivotable about an axis parallel to the axis of the curved disc and that the free end of the piston rod of the pump abuts in and is displaceable along an arm, one end of which is mounted rotatably about a third axis parallel to the two first axes and the other end of which abuts on the curved disc.

3. A machine according to claim 2 and comprising a hydraulic system for controlling the movement of the advancing means and including an accumulator, characterized by hydraulic coupling means which during the reverse movement of the advancing means connect the pump with the accumulator and with a hydraulic pump adjustment cylinder connected to the pump housing so as to swing the pump housing into the position in which the piston rod engages the outer end of the arm.

4. A machine according to claim 3, characterized in that the space behind the plunger of the hydraulic cylinder communicates with a second accumulator and through a relief valve with a reservoir for hydraulic fluid.

5. A machine according to claim 4, characterized by a valve which on being activated establishes communication between the two ends of the hydraulic cylinder.

* * * * *